US006012162A

United States Patent [19]

Bullat

[11] Patent Number: 6,012,162

[45] Date of Patent: Jan. 11, 2000

[54] HIGH IMPACT ABSORBING BODY ARMOR WITH SELF ACTUATING MODE

[75] Inventor: David M. Bullat, Carlsbad, Calif.

[73] Assignee: The United States of America as represented by the Secretary of the Navy, Washington, D.C.

[21] Appl. No.: 09/103,861

[22] Filed: Jun. 24, 1998

[51] Int. Cl.[7] ..... F41H 1/02

[52] U.S. Cl. ..... 2/2.5; 2/455; 2/456

[58] Field of Search ..... 2/2.5, 102, 455, 2/456, 463, 464, 465, 467, DIG. 3, 81, 93

[56] References Cited

U.S. PATENT DOCUMENTS

| | | | |
|---|---|---|---|
| 3,431,818 | 3/1969 | King . | |
| 3,622,035 | 11/1971 | Suter . | |
| 3,921,944 | 11/1975 | Morrison | 2/456 |
| 3,930,667 | 1/1976 | Osuchowski et al. | 2/DIG. 3 |
| 4,059,852 | 11/1977 | Crane | 2/DIG. 3 |
| 4,194,431 | 3/1980 | Markus et al. . | |
| 4,453,271 | 6/1984 | Donzis . | |
| 4,637,074 | 1/1987 | Taheri | 2/DIG. 3 |
| 4,680,812 | 7/1987 | Weigl . | |
| 4,685,151 | 8/1987 | Kincheloe | 2/DIG. 3 |
| 4,825,469 | 5/1989 | Kincheloe | 2/DIG. 3 |
| 4,984,821 | 1/1991 | Kim et al. | 2/DIG. 3 |
| 5,059,467 | 10/1991 | Berkovitz . | |
| 5,086,514 | 2/1992 | Ross . | |
| 5,087,516 | 2/1992 | Groves | 2/2.5 |
| 5,195,752 | 3/1993 | Reeves et al. | 2/102 |
| 5,303,425 | 4/1994 | Mele | 2/102 |
| 5,312,675 | 5/1994 | Cooper et al. . | |
| 5,362,098 | 11/1994 | Guill . | |
| 5,435,226 | 7/1995 | McQuilkin . | |
| 5,443,882 | 8/1995 | Park . | |
| 5,471,906 | 12/1995 | Bachner, Jr. et al. | 2/2.5 |
| 5,619,748 | 4/1997 | Nelson et al. | 2/2.5 |
| 5,636,378 | 6/1997 | Griffith | 2/102 |
| 5,771,489 | 6/1998 | Snedeker | 2/2.5 |
| 5,781,936 | 7/1998 | Alaloof | 2/455 |
| 5,860,163 | 1/1999 | Aldridge | 2/81 |

*Primary Examiner*—Michael A. Neas
*Assistant Examiner*—Gary L. Welch
*Attorney, Agent, or Firm*—Harvey Fendelman; Michael A. Kagan; Peter A. Lipovsky

[57] ABSTRACT

An article of protective clothing includes a hardened armor section such as impact shields and an underlying layer incorporating one or more inflatable fluid cavities or cushions. The fluid cavities are in communication with a reservoir of fluid under pressure. The reservoir can be used in conjunction with an impact sensor that directs the fluid to the cushions upon projectile impact or can be directed to supply fluid to the cushions upon user demand. In either case, inflation of the cushions is only accomplished when needed, thereby enhancing the comfort of a user.

10 Claims, 2 Drawing Sheets

HIGH IMPACT ABSORBING BODY ARMOR WITH SELF ACTUATING MODE

BACKGROUND OF THE INVENTION

The invention relates generally to a mechanism for protecting a human from the trauma associated with the bodily impact of ballistic objects. More specifically, the invention relates to body armor designed to shield its users from the dangers of large caliber, high energy, bullet impact. In greater specificity, the invention relates to body armor that can be actuated by the impact of a ballistic object on the body armor or by a user of the body armor.

Military personnel, law enforcement members and others can frequently be exposed to the threats presented by firearms. Bulletproof vests and protective body armor have been developed to counter these threats.

Prior art designed to repel these threats have focused largely on simply stopping an impacting object, with secondary emphasis placed on dissipating the impact energy of the object. The result can be success in preventing the object from achieving bodily penetration, however local trauma may develop which may ultimately cause serious injury if not death to the user of these designs.

Some of these prior art designs include vests or other garments composed of high-strength, lightweight fibers, such as DuPont Kevlar™ or Allied Signal Spectra™. These garments, while significantly minimizing projectile penetration, still permit a significant amount of impact energy to be transferred to the user, resulting in a likelihood of temporary if not permanent local trauma.

Other prior art solutions have been designed with rigid panels that are held close to a user's body, usually in proximity to vital organs. While these panels are often successful in minimizing the penetration of even higher energy projectiles, impact energy from such projectiles can still transfer through the rigid panels and be adversely absorbed by the user's body.

It is further known to incorporate fluid compartments in body armor that are designed to dissipate impact energy over an enlarged surface area and hence lessen impact effects on the user of such a design. Some such compartments have been incorporated with pressure limiters, further permitting a controlled dissipation of impact energy.

While the incorporation of fluid compartments with body armor has had its attendant advantages, the compartments are often bulky and can have thermal insulating effects, both of which can limit the manual dexterity of its user.

There is thus a need within the art for a body armor system that minimizes the penetration and impact effects of high energy projectiles, while at the same time permits comfort and manual dexterity to its user.

SUMMARY OF THE INVENTION

An article of protective clothing includes a hardened armor section such as impact shields and an underlying layer incorporating one or more inflatable fluid cavities or cushions. The fluid cavities are in communication with a reservoir of fluid under pressure. The reservoir can be used in conjunction with an impact sensor that directs the fluid to the cushions upon projectile impact or can be directed to supply fluid to the cushions upon user demand. In either case, inflation of the cushions is only accomplished when needed, thereby enhancing the comfort of a user.

OBJECTS OF THE INVENTION

An object of this invention is to provide body armor that minimizes injuries resulting from ballistic impact.

Another object of the invention is to provide body armor that minimizes both penetration and impact injuries due to projectiles.

A further object of this invention is to provide body armor that minimizes projectile penetration and impact injuries, and does so via a garment that is comfortable to a user thereof.

Still a further object of this invention is to provide body armor that minimizes projectile penetration and impact injuries, and does so via a garment that permits a high degree of manual dexterity to a user thereof.

Yet still a further object of this invention is to provide body armor that incorporates a hardened armor section with an inflatable cushion disposed to fall between the hardened armor section and the body of a user.

A further object of this invention is to fulfill the immediately aforesaid object while having the further object of providing a filling of the aforementioned fluid cushion upon impact of a projectile with said body armor and/or demand of a user of the body armor.

Other objects, advantages and new features of the invention will become apparent from the following detailed description of the invention when considered in conjunction with the accompanying drawings.

DESCRIPTION OF THE PREFERRED EMBODIMENT

This invention may be applied to a variety of articles of protective clothing such as vests, jackets, aprons, shirts and/or trousers.

Figure 1:
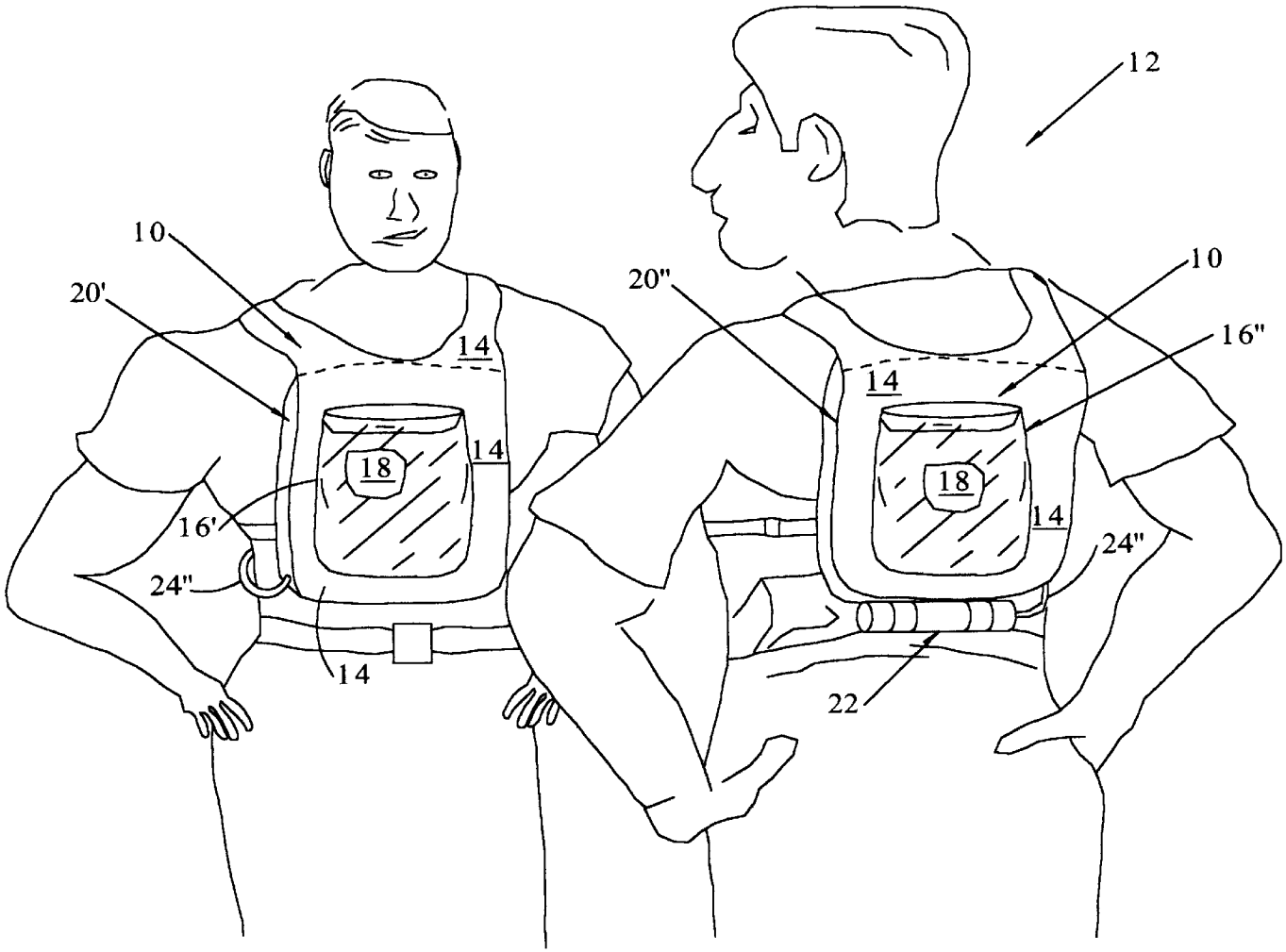
FIG. 1 is a profile view illustrating one embodiment and use of the invention.

Referring to FIG. 1, an embodiment of the invention is shown as taking the form of a vest 10. Vest 10 substantially covers the anterior and posterior upper torso sections of a user 12, however one skilled in the art will realize that other areas of the upper torso as well as of the body can be protected by the invention.

In a preferred embodiment, a majority of vest 10 is generally constructed according to the materials and specifications of a typical so-called "bullet-proof" vest, comprising an energy absorbing high strength fiber vest section 14 such as, for example, one made of a polyaramid fiber such as Kevlar™ or a polyethylene fiber such as Spectra™. Such bullet-proof fabric may be made by methods which include, but are not limited to, weaving, knitting, sewing or layering the fibers together to form an appropriate fiber matrix.

As can be seen, a pocket 16' and a pocket 16" are attached to fiber section 14 of the anterior and posterior exterior of vest 10, respectively. A hardened armor section 18, portions of which are shown through cut-away views of pockets 16' and 16", is placed in each of the pockets. Hardened armor section 18 may be comprised of a single plate, or a plurality of plates, such as for example, those shown in U.S. Pat. No. 4,680,812. Armor sections 18 may be comprised of a variety of materials, such as, for example, steel, aluminum, magnesium, metal wire, carbon-fiber, ceramics or any combination of these.

The hardened armor may be disposed or placed in relationship to the wearer's body in a variety of ways, such as, but not limited to, a plate located over the heart, a plate covering other essential organs, a plate covering the spine or portions of the spine, or any combination of these.

The armor plates may be attached to the vest in a number of different ways, such as, but not limited to, the integral pouches shown, a hook and loop system, or a combination of these.

As can be seen, vest 10 is further designed to include an expandable enclosed pocket portion 20' and 20", in part outlined by phantom lines, disposed to fall between the body of user 12 and the posterior and anterior located armor plates 18, respectively. A preferred embodiment of the invention includes, but is not limited to, expandable portions that cover a chest area larger than the area of armor 18.

Expandable portions 20' and 20" are preferably comprised of additional segments of the previously described energy absorbing polyaramid or polyethylene fiber material, and each are constructed to define an enclosed cavity in which an inflatable cushion or a multitude of interconnected inflatable cushions, to be further described, are disposed. The cushions, for example, may be of polyurethane, vinyl, compliant polymer or other suitable material.

FIG. 1 further depicts a cushion pressurization system 22 to be further discussed comprising a reservoir of fluid under pressure, an operably coupled electronic valve, and an operably coupled pressure release valve. Cushion pressurization system 22 is in fluid communication with the cushions within expandable portions 20' and 20" of vest 10 via umbilicals 24' and 24", respectively.

Figure 2:
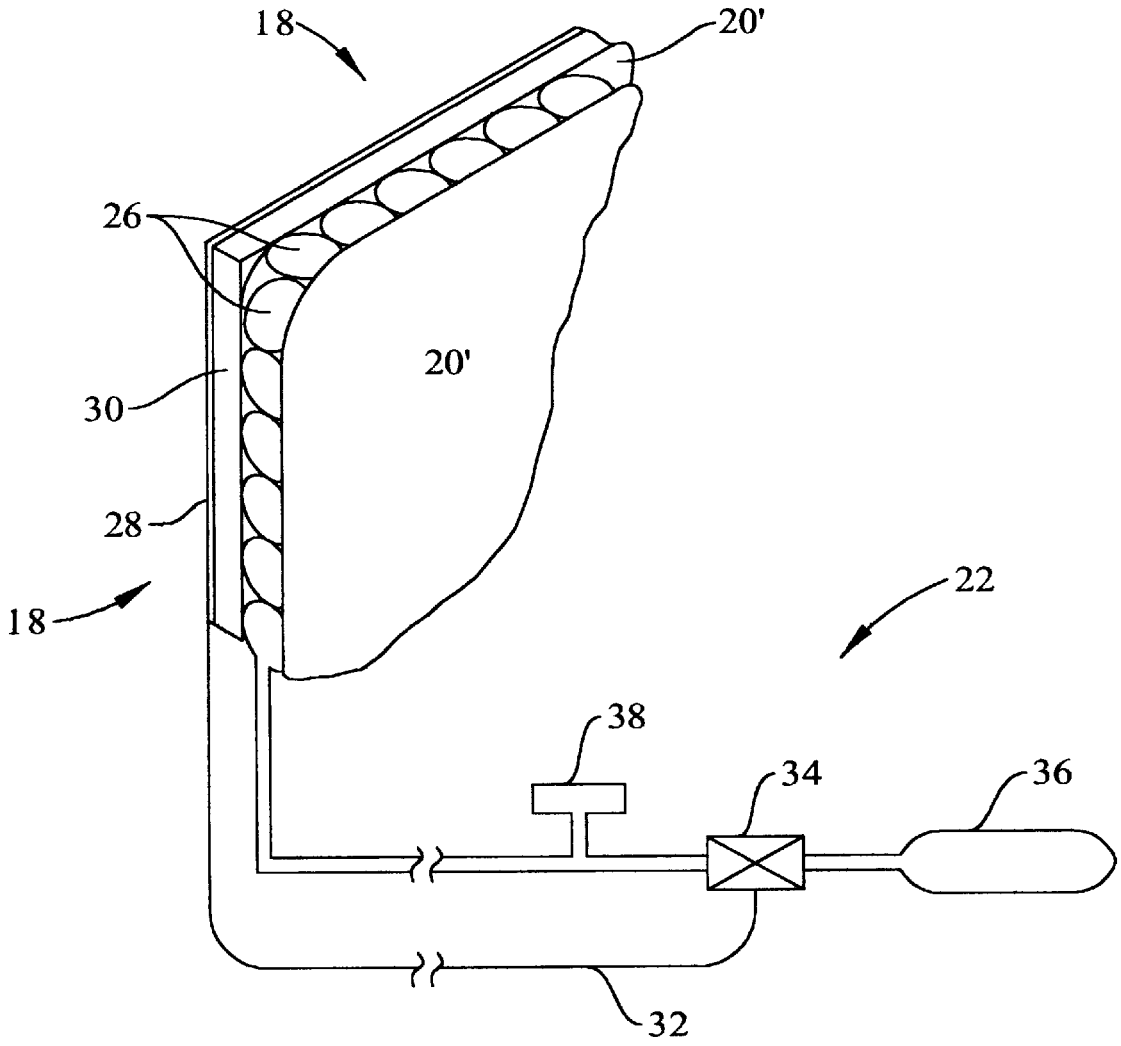
FIG. 2 illustrates a perspective cross-section of a portion of the invention.

Referring now to FIG. 2, a perspective partial cross-section of the invention not drawn to scale is shown in which a portion of armor plate 18 is shown in coordination with a portion of expandable vest portion 20' located on the anterior side of user 12. Of course this illustration is also considered to be applicable to the corresponding elements of the invention disposed on the posterior side of vest 10 as depicted in FIG. 1. Expandable vest portion 20' is partially cut-away to reveal interconnected inflatable cushions 26, shown in an inflated state. In an uninflated state, inflatable cushions 26 are substantially flat. For drawing simplification purposes, cushions 26 are shown as largely conforming to the area of armor 18, however as is illustrated in FIG. 1, a preferred embodiment of the invention includes a cushion and accompanying expandable vest section that extends beyond the borders of armor 18. Of course, the precise area of the user to be covered by the expandable sections and accompanying cushions is dependent upon the degree of shock dissipation desired and will be dependent upon the nature of the projectile impacts expected.

In a preferred embodiment of the invention, hardened armor 18 includes an outer brittle ceramic layer 28 disposed upon a hardened steel plate 30. Layer 28 may be applied to the armor plate by any of a variety of methods, such as, but not limited to, spraying, baking, dipping, gluing, or any combination of these.

In one embodiment of the invention, ceramic layer 28 includes a piezoelectric material that, in a well understood manner, is used to generate an electrical signal upon being stressed, in this case, by the impact of a projectile. The signal generated by the material is conducted through line 32, that is incorporated within umbilicals 24 of FIG. 1, and provides an electric signal to an electronic valve 34 within fluid pressurization system 22, the components of system 22 being shown in block form. An alternative embodiment could utilize a conductive layer incorporated into energy absorbing underlayer 14 to connect the piezoelectric material to electronic valve 34.

In either case, the piezoelectric signal causes the valve to open to allow fluid under pressure to flow from a container 36 containing the pressurized fluid into the deflated cushions of the invention to inflate these cushions. One of ordinary skill in the art will realize that the technology of modem automobile air bag systems can be drawn upon and be suitably modified for use with this invention.

The container 36 of pressurized fluid serves as a reservoir of a fluid such as, but not limited to, air, another gas, a liquid, or any combination of these. Preferably, container 36 contains air under pressure and is of a minimal size and weight. The fluid container 36 may be comprised of any one of a variety of materials, such as, but not limited to, steel, aluminum, Kevlar™, carbon-fiber, or any combination of these. Preferably, fluid container 36 is comprised either of aluminum or a Kevlar™-wound aluminum, and is designed to configure to a user's profile.

An alternative embodiment includes a cushion pressurization system that is usable upon demand. The cushions of the invention could be filled or emptied on user demand by the user manually operating valve 34. In either embodiment, the valve is preferably configured to the user's profile, and is of minimal size and weight.

In either embodiment of the invention, cushion pressurization system 22 includes a pressure relief valve 38 that opens when the fluid within cushions 26 reach a predetermined pressure thereby preventing over pressurization of the cushions and allowing controlled exhausting of the cushions to take place. Such controlled exhausting is designed to further lessen the impact loading placed upon a user of the invention when the invention is called into action. Relief valve 38 can also be actuated manually where a user desires to deflate the cushions of the invention upon demand. Preferably, the pressure relief valve is configured to the user's profile, and is of minimal size and weight.

While the invention has been described as employing a hardened armor section, one of ordinary skill in the art will realize that in a threat environment where use of high powered firearms is unlikely, a lighter and less bulky vest may be realized by doing away with the armor section. In this embodiment the spirit of the invention in which an impact sensor is employed to inflate one or more impact absorbing cushions is still possible. Similarly, such an embodiment could employ a mechanism in which these cushions could be filled and exhausted at the will of a user.

These combinations of preferred embodiments can provide a range of ballistic protection, from high-threat projectiles to low-threat projectiles.

Obviously, many modifications and variations of the invention are possible in light of the above teachings. It is therefore to be understood that within the scope of the appended claims the invention may be practiced otherwise than as has been specifically described.

What is claimed is:

1. A protective garment comprising:

a projectile penetrant inhibitor section including an armor plate;

an inflatable shock-absorbing cushion disposed to fall between at least a portion of said armor plate and the body of a user of said protective garment, said inflatable shock-absorbing cushion being operable between a deflated, low-impact absorbing state and an inflated, high-impact absorbing state;

a cushion pressurization system including a source of pressurized fluid in fluid communication with said inflatable shock-absorbing cushion and a valve for regulating the flow of said fluid to said inflatable shock-absorbing cushion; and an impact sensor forming an integral part of said garment, said impact sensor being disposed in contact with at least a portion of said armor plate and being operably coupled to said valve so that when said impact sensor senses the impact of a projectile thereon said impact sensor generates a signal to said valve to release said pressurized fluid to inflate said inflatable shock-absorbing cushion.

2. The protective garment of claim 1 further including a pressure relief operably coupled to said cushion for releasing pressure therein when said pressure reaches a predetermined level.

3. The protective garment of claim 1 in which said projectile penetrant inhibitor section includes an energy absorbing high strength fiber.

4. The protective garment of claim 3 in which said energy absorbing high strength fiber is chosen from the group consisting of polyaramids and polyethylenes.

5. The protective garment according to claim 1 in which said impact sensor includes a piezoelectric material.

6. A protective garment comprising:

a hardened armor section;

an inflatable shock-absorbing cushion disposed to fall between at least a portion of said hardened armor section and the body of a user of said protective garment, said inflatable shock-absorbing cushion being operable between a deflated, low-impact absorbing state and an inflated, high-impact absorbing state;

a reservoir of fluid under pressure disposed in communication with said inflatable shock-absorbing cushion;

a valve operably coupled between reservoir of fluid and said inflatable shock-absorbing cushion for regulating the flow of said fluid to said cushion; and an impact sensor disposed in contact with said hardened armor for sensing the impact of a projectile thereon, said impact sensor being operably coupled to said valve so that said valve is opened and permits said fluid to flow into said cushion upon said impact sensor sensing the impact of a projectile thereon.

7. The protective garment of claim 6 in which said impact sensor includes a piezoelectric layer disposed on an outlying surface of said hardened armor section.

8. The protective garment of claim 6 further including a pressure relief operably coupled to said cushion for releasing pressure therein when said pressure reaches a predetermined level.

9. The protective garment of claim 6 in which said inflatable shock-absorbing cushion is enclosed within an expandable pocket comprising of an energy absorbing high strength fiber.

10. The protective garment of claim 9 in which said energy absorbing high strength fiber is chosen from the group consisting of polyaramids and polyethylenes.

* * * * *